US006786759B1

(12) United States Patent
Lin et al.

(10) Patent No.: US 6,786,759 B1
(45) Date of Patent: Sep. 7, 2004

(54) CABLE END CONNECTOR ASSEMBLY HAVING PULL MECHANISM

(75) Inventors: Hsien-Chu Lin, Tu-chen (TW); Shih Tung Chang, Tu-chen (TW); Chin Pao Kuo, Tu-chen (TW); Yun Long Ke, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/406,691

(22) Filed: Apr. 2, 2003

(51) Int. Cl.[7] ..... H01R 13/00
(52) U.S. Cl. ..... 439/483
(58) Field of Search ..... 439/483, 484, 439/405, 404, 456, 459

(56) References Cited

U.S. PATENT DOCUMENTS 3,654,589 A * 4/1972 Di Stefano et al. ..... 439/483
4,379,361 A 4/1983 Webster et al.
4,583,803 A * 4/1986 Bringuel ..... 439/160
4,881,911 A * 11/1989 Haddock et al. ..... 439/484
5,446,622 A * 8/1995 Landry et al. ..... 361/737
6,319,049 B1 * 11/2001 Lee ..... 439/484
6,416,353 B1 7/2002 Hwang et al.
6,416,354 B1 * 7/2002 Lee ..... 439/484
6,500,023 B1 * 12/2002 Duong et al. ..... 439/484

* cited by examiner

*Primary Examiner*—Gary Paumen
(74) *Attorney, Agent, or Firm*—Wei Te Chung

(57) ABSTRACT

A cable end connector assembly (1) includes an insulative housing (10), a number of contacts (20), a number of wires (30), a shell (40, 50) and a pull mechanism (60). The insulative housing includes a number of passageways (11). The contacts are received in the passageways of the insulative housing. The wires are electrically connected with the contacts. The shell is assembled to the insulative housing. The pull mechanism includes a mounting member (61) assembled to the shell and a pull tab (62) engaged with the mounting member and having a pull portion (621) for being pulled.

11 Claims, 5 Drawing Sheets

CABLE END CONNECTOR ASSEMBLY HAVING PULL MECHANISM

BACKGROUND OF THE INVENTION

1. Field of the Invention

The present invention relates to an electrical connector assembly, and particularly to a cable end connector assembly having a pull mechanism to facilitate disengaging the cable end connector assembly from a mating complementary connector. This application relates to a contemporaneously filed application having the same applicant, the same assignee and the same title with the invention.

2. Description of Prior Art

There exists in the art a cable end connector assembly matable with an electrical connector mounted on a printed circuit board for transmitting signals therebetween. To facilitate removing the cable end connector assembly from connection with the complementary connector, pull mechanisms have been used. Such pull mechanisms generally permit applying a withdrawing force to the cable end connector assembly without directly pulling a cable of the cable end connector assembly.

U.S. Pat. No. 4,379,361 (the '361 patent) discloses one type of pull mechanism. In conjunction with FIG. 3 of the '361 patent, a cable end connector assembly 1 has a pull tab 50 partially inserted in a connector body 9 of the assembly 1 between two rows of contacts 7 of the assembly 1 for user pinching and pulling when the assembly 1 is to be disengaged from a complementary connector. However, to comply with miniaturization trends in the electronic field, the cable end connector assembly is required to be manufactured much smaller than before, and the contacts of the assembly are arranged much closer than before. Therefore, there will be no enough room inside the connector body 9 to accommodate the pull tab 50.

U.S. Pat. No. 6,416,353 (the '353 patent) discloses another type of pull mechanism. In conjunction with FIG. 1 of the '353 patent, a cable end connector assembly 1 has a pull mechanism 7 assembled outside of an elongated housing 30 thereof. The housing 30 is formed with a pair of locking structure at opposite ends thereof, and the pull mechanism 7 comprises an arch pull leash 70 and a pair of locking tabs 72 engageable with the pull leash 70 and the locking structure of the housing 30. Thus, the assembly 1 can be disengaged from a complementary connector readily by pulling the pull leash 70. Whereas, such pull mechanism and locking structure are not adapted for a miniature cable end connector assembly, because the sizes of the pull mechanism and the locking structure are required to be much smaller to correspond to the miniature connector assembly, which will make the configurations of the pull mechanism and the locking structure become quite complicated comparing with they being in original sizes. Therefore, a mass of trouble will be encountered in manufacturing and assembling the pull mechanism and the locking structure.

Hence, an improved cable end connector assembly is required to overcome the disadvantages of the prior art.

SUMMARY OF THE INVENTION

A major object of the present invention is to provide a cable end connector assembly with a pull mechanism facilitating manufacturing and assembling thereof.

In order to achieve the object set forth, a cable end connector assembly comprises an insulative housing, a plurality of contacts, a plurality of wires, a shell and a pull mechanism. The insulative housing comprises a plurality of passageways. The contacts are received in the passageways of the insulative housing. The wires are electrically connected with the contacts. The shell is assembled to the insulative housing. The pull mechanism comprises a mounting member assembled to the shell and having a main plate, and a pull tab engaged with the main plate of the mounting member and having a pull portion for being pulled.

Other objects, advantages and novel features of the invention will become more apparent from the following detailed description when taken in conjunction with the accompanying drawings.

DETAILED DESCRIPTION OF THE INVENTION

Figure 1:
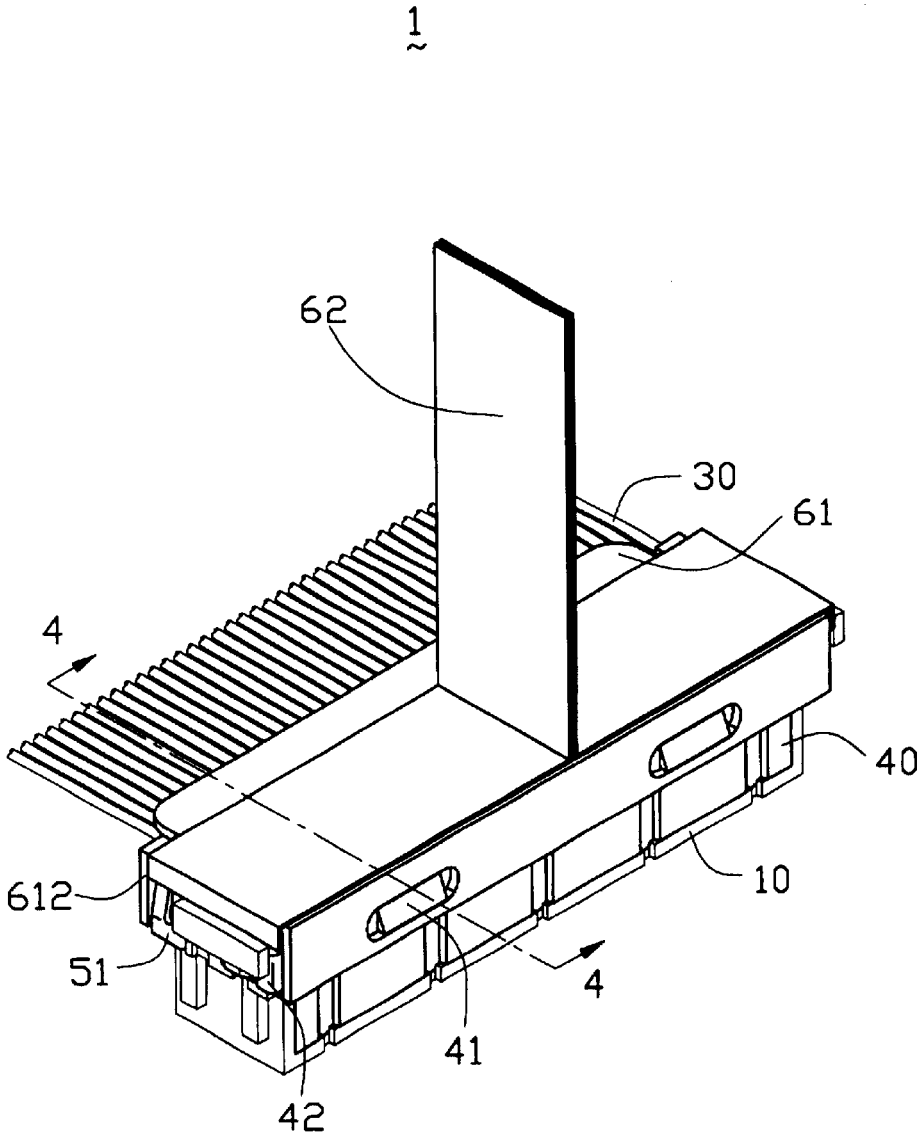
FIG. 1 is a perspective view of a cable end connector assembly in accordance with the present invention.

Referring to FIGS. 1, 2, 4 and 6, a cable end connector assembly 1 in accordance with the present invention comprises an elongated insulative housing 10, a plurality of contacts 20, a plurality of wires 30, a first and a second shells 40, 50, and a pull mechanism 60.

Figure 2:
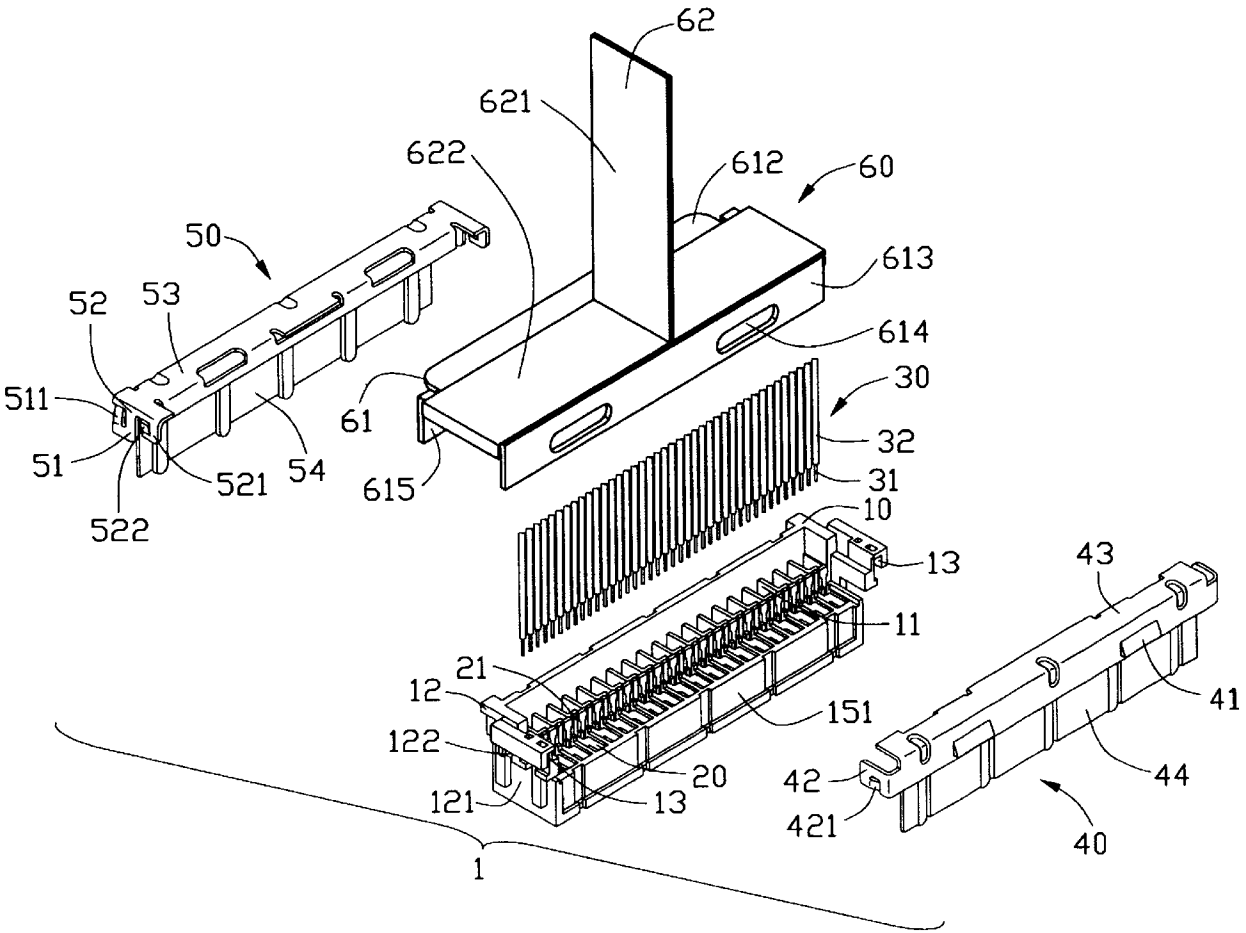
FIG. 2 is an exploded perspective view of the cable end connector assembly of FIG. 1.

Referring to FIG. 2, the insulative housing 10 includes two end walls 121, a front and a rear walls 151, 152 (see FIG. 4) connecting to the end walls 121, and a bottom wall 16 (see FIG. 6) connecting to the end, the front and the rear walls 121, 151, 152. The insulative housing 10 defines a plurality of passageways 11 therein and a plurality of apertures 14 (see FIG. 6) communicating with corresponding passageways 11 in the bottom wall 16 for receiving contacts of a complementary connector (not shown). Each end wall 121 comprises a groove 13 at a front end thereof, a first step portion 131 (see FIG. 5) formed thereon, a second step portion 12 at a rear end thereof and a slot 122 between the first step portion 131 and the second step portion 12.

Each contact 20 includes a contacting portion 22 (see FIG. 4) received in corresponding passageway 11 of the insulative housing 10 and a tail portion 21 extending from the contacting portion 22.

Each wire 30 includes a conductor 31 electrically connected with the tail portion 21 of each contact 20 and an insulator 32 enclosing the conductor 31.

The first and the second shells 40, 50 have a similar configuration. Each shell 40 (50) includes an elongated right-angle main portion 43 (53) and an abutting portion 44 (54) extending downwardly from the main portion 43 (53). Each main portion 43 (53) includes a horizontal portion 431 (531) (see FIG. 4) and a vertical portion 432 (532) (see FIG. 4) perpendicular to the horizontal portion 431 (531). The main portion 43 of the first shell 40 further comprises two wedge-shaped projections 41 projecting forwardly from the vertical portion 432 thereof and a pair of first engaging portions 42 extending rearwardly from opposite lower ends of the vertical portion 432. The main portion 53 of the second shell 50 comprises a pair of second engaging portion 51 extending downwardly from opposite ends of the horizontal portion 531 thereof. Each first engaging portion 42 is formed with a first tab 421 extending sidewardly at distal end thereof. Each second engaging portion 52 includes a front section 521 and a rear section 51. The front section 521 is formed with a wedge-shaped protrusion 522 projecting therefrom. The rear section 51 comprises a second tab 511 extending sidewardly at distal end thereof.

Figure 3:
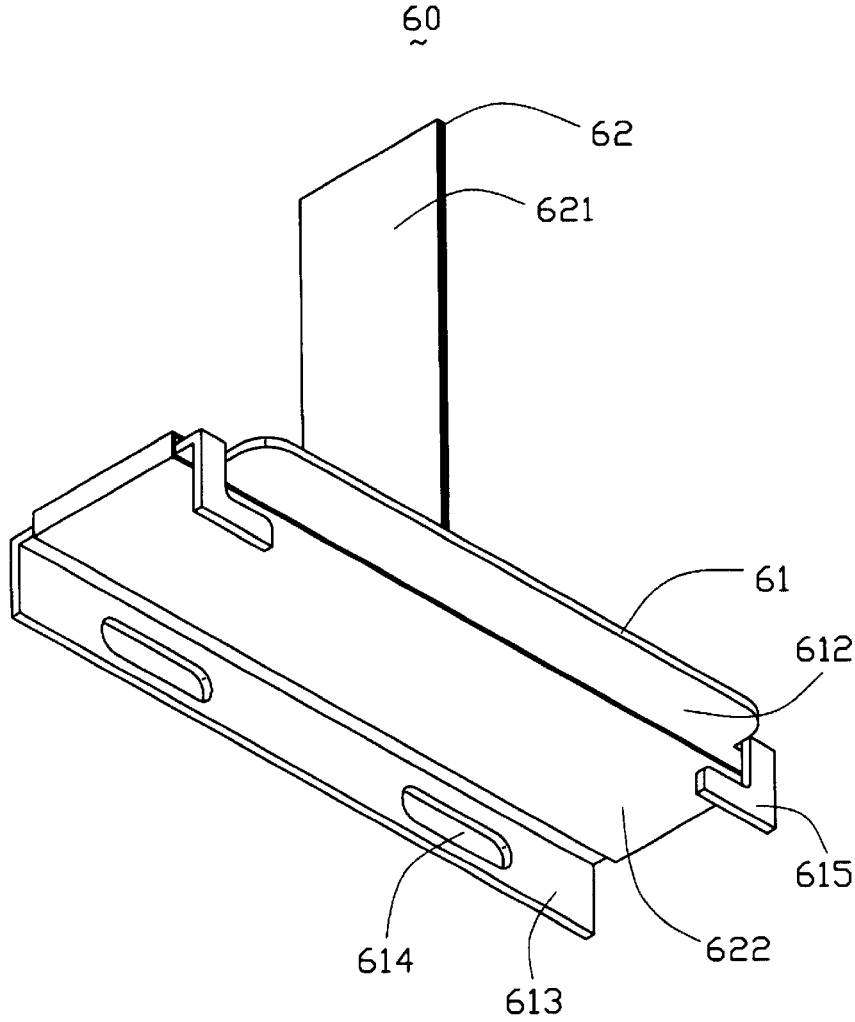
FIG. 3 is a perspective view of a pull mechanism of the cable end connector assembly of FIG. 2 from a different aspect.

Referring to FIG. 3, the pull mechanism 60 includes a mounting member 61 and a pull tab 62. The mounting member 61 is stamped from a metallic sheet and includes a main plate 612, a connecting plate 613 extending downwardly from one side of the main plate 612, and a pair of L-shaped legs 615 extending downwardly from opposite ends of the other side of the main plate 612. The connecting plate 613 defines two openings 614 therein. The pull tab 62 is made of plastic or plastic-like sheet material.

In assembly, the pull tab 62 is overlapped to form a receiving portion 622 for receiving the main plate 612 of the mounting member 61 and a pull portion 621 at end thereof for being pinched by user. The receiving portion 622 wraps the main plate 612 along an elongated direction of the main plate 612. The connecting plate 613 and the legs 615 limit the receiving portion 622 of the pull tab 62 from moving in a lateral direction perpendicular to the elongated direction.

Figure 4:
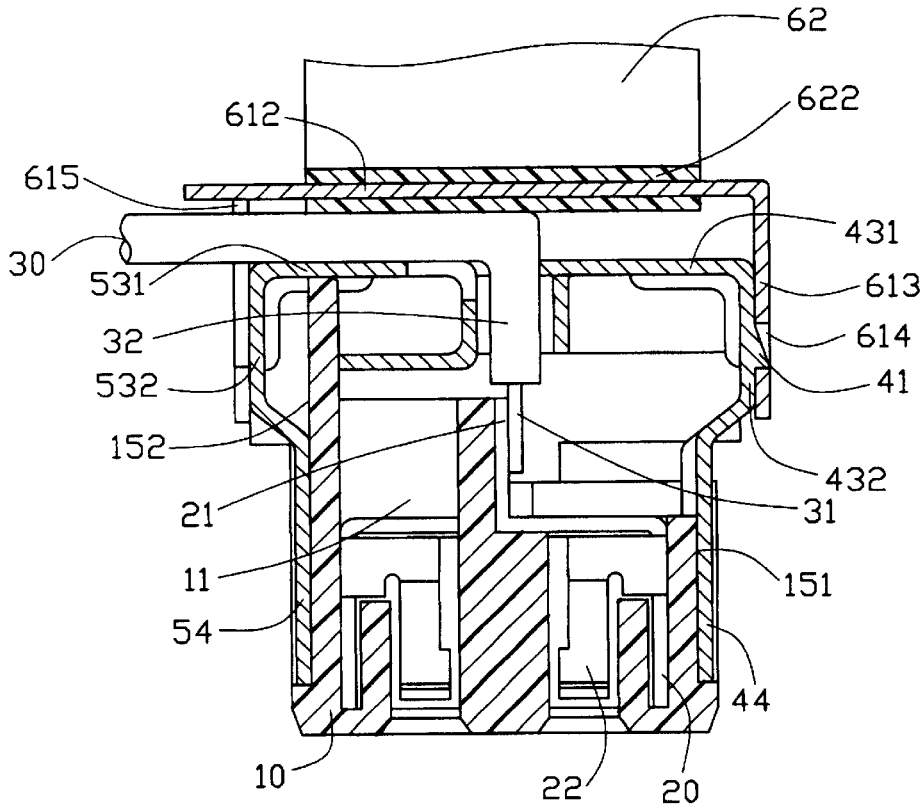
FIG. 4 is a cross-sectional view taken along line 4—4 of FIG. 1.
Figure 5:
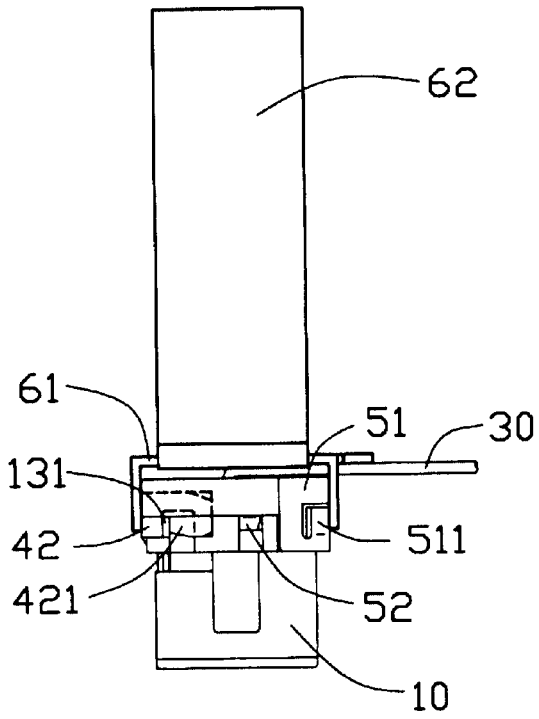
FIG. 5 is a side view of the cable end connector assembly of FIG. 1.
Figure 6:
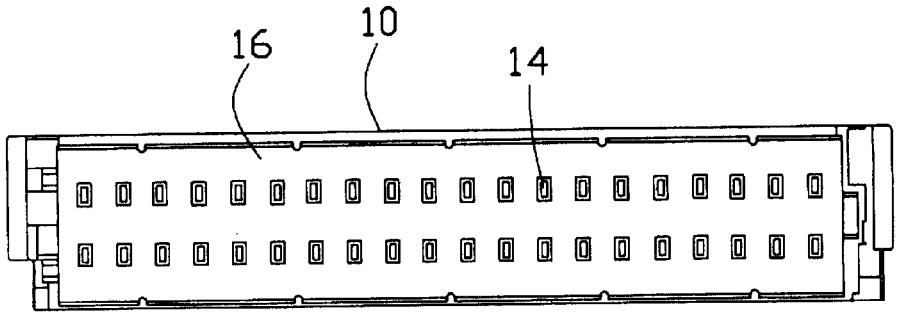
FIG. 6 is a bottom view of the cable end connector assembly of FIG. 1, wherein a plurality of wires of the cable end connector assembly are not shown.

Referring to FIGS. 2, 4 and 5, the contacts 20 are received in the passageways 11 of the insulative housing 10, and the wires 30 are electrically connected to the contacts 20 with the conductors 31 of the wire 30 being soldered to the tail portions 21 of corresponding contacts 20. The first shell 40 is assembled to the insulative housing 10 along a front-to-rear direction. The first engaging portions 42 are inserted into the groove 13 with the first tab 421 engaging with the first step portion 131, and the abutting portion 44 abuts against the front wall 151 of the insulative housing 10. The second shell 50 is assembled to the insulative housing 10 along a top-to-bottom direction. The front section 521 of the second engaging part 52 is inserted into the slot 122 of the insulative housing 10 with the protrusion 522 abutting against the insulative housing at a bottom face of the slot 122. The second tab 511 of the rear section 51 of the second engaging portion 52 engages with the second step portion 12, and the abutting portion 54 of the second shell 50 abuts against the rear wall 152 of the insulative housing 10.

At this time, the wires 30 extend upwardly from a position between the first and second shells 40, 50 parallel to a direction along which the complementary connector mates to the assembly 1. The projections 41 of the shell 40 are received in the openings 614 of connecting plate 613. The legs 615 of the mounting member 61 are soldered to the second shell 50, and the wires 30 extend through the space between the two legs 614 perpendicular to the direction along which the complementary connector mates to the assembly 1. By this way, the pull mechanism 60 is readily and securely attached to the shell 40, 50.

When the cable end connector assembly 1 needs to be removed from the complementary connector, the pull portion 621 of the pull tab 62 is pulled upwardly. The pull force is then transmitted to the mounting member 61 by the engagement between the receiving portion 622 of the pull tab 62 and the main plate 612 of the mounting member 61. The pull force is finally transmitted to the whole assembly 1 by the engagement between the mounting member 61 and shell 40, 50, thereby the assembly 1 being disengaged from the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

an insulative housing comprising a plurality of passageways;

a plurality of contacts received in the passageways of the insulative housing;

a plurality of wires electrically connected with the contacts;

a shell metal assembled to the insulative housing; and a pull mechanism comprising a mounting member assembled to the shell and a pull tab fixed to the mounting member and having a pull portion for being pulled.

2. The cable end connector assembly as claimed in claim 1, wherein the pull portion of the pull tab extends parallel to a direction along which the passageways of the insulative housing extend.

3. The cable end connector assembly as claimed in claim 1, wherein the mounting member comprises a main plate, and wherein the pull tab comprises a receiving portion receiving the main plate.

4. The cable end connector assembly as claimed in claim 3, wherein the receiving portion wraps the main plate along a longitudinal direction of the main plate.

5. The cable end connector assembly as claimed in claim 3, wherein the mounting member comprises a leg extending from the main plate and soldered to the shell.

6. The cable end connector assembly as claimed in claim 5, wherein the mounting member comprises a connecting plate extending from the main plate and defining an opening, and wherein the shell is formed with a projection received in the opening.

7. The cable end connector assembly as claimed in claim 6, wherein the shell comprises a first and a second shells, wherein the leg is soldered to the second shell, and wherein the projection projects from the first shell.

8. The cable end connector assembly as claimed in claim 7, wherein the wires extend from a region between the first and second shells and then perpendicularly to the direction along which the passageways of the insulative housing extend.

9. A cable end connector assembly comprising:

an insulative housing with a plurality of contacts therein;

a plurality of wires connected to the corresponding contacts, respectively;

a shell assembly attached to the housing;

a pull mechanism including a mounting member attached to at least one of said housing and said shell metal assembly, and pull tab wrapping said mounting member with a pull portion exposed to an exterior; wherein a horizontal passage is defined under the mounting member, and said wires extend through said passage.

10. The assembly as claimed in claim 9, wherein said shell assembly includes opposite front and rear shells, and the pull mechanism is assembled both said front and rear shells.

11. The assembly as claimed in claim 9, wherein said pull portion defines a plane perpendicular to a lengthwise direction of the housing.

* * * * *